United States Patent [19]

Verboom

[11] 4,259,795

[45] Apr. 7, 1981

[54] DRAGGING TYPE CUTTER HEAD FOR A SUCTION DREDGER

[75] Inventor: Pieter Verboom, Alblasserdam, Netherlands

[73] Assignee: IHC Holland N.V., Rotterdam, Netherlands

[21] Appl. No.: 49,656

[22] Filed: Jun. 19, 1979

[30] Foreign Application Priority Data

Jul. 18, 1978 [NL] Netherlands ..... 7807683

[51] Int. Cl.[3] ..... E02F 3/88

[52] U.S. Cl. ..... 37/66

[58] Field of Search ..... 37/66, 64, 65, 67, 70, 37/58

[56] References Cited

U.S. PATENT DOCUMENTS

| | | | |
|---|---|---|---|
| 1,106,038 | 8/1914 | Fruhling | 37/66 |
| 1,701,280 | 2/1929 | Sorensen | 37/66 |
| 2,309,157 | 1/1943 | Ariens | 37/189 UX |
| 2,364,666 | 12/1944 | Seaman | 37/189 UX |
| 2,926,436 | 3/1960 | Humphreys | 37/67 |

FOREIGN PATENT DOCUMENTS

| | | | |
|---|---|---|---|
| 363002 | 4/1906 | France | 37/66 |
| 1679 | 11/1916 | Netherlands | 37/66 |
| 7406867 | 11/1975 | Netherlands | 37/66 |
| 1383089 | 2/1975 | United Kingdom | 37/72 |

OTHER PUBLICATIONS

"The Suction Dredger Johanna Jacoba"; Nivag Contour, vol. 3, May, 1978, No. 5.

*Primary Examiner*—Clifford D. Crowder
*Attorney, Agent, or Firm*—Young & Thompson

[57] ABSTRACT

A dragging type cutter head for a suction dredger has a cutting member that rotates about a horizontal axis and has at its periphery a series of cutting teeth disposed side-by-side in the axial direction. At the lowermost point in their rotation, the cutting teeth rotate in the dragging direction. The dragging head has an inlet opening for cut material, whose edges extend to the outer circle of rotation of the cutter teeth with the lower edge of that opening at the same level as the lower part of the cutting member. The cutting teeth are pivotal on horizontal axes spaced from that of the cutting member; and springs urge the cutting teeth about their axes in the cutting direction.

7 Claims, 2 Drawing Figures

DRAGGING TYPE CUTTER HEAD FOR A SUCTION DREDGER

The invention relates to a dragging type cutter head for a suction dredger, said head being provided with a cutting member adapted to be driven, and mounted in front of the mouth of the suction conduit and consisting of a substantially cylindrical body rotatable around a horizontal axis and provided at its periphery with series of cutting teeth disposed side by side in axial direction, said cutting member having a cutting action in a direction opposite to the dragging direction. Such a dragging type head is known from the Dutch Patent Application No. 73.11208 laid open to public inspection, and particularly from FIGS. 3 and 5. This publication shows a dragging type head with two rotary cutting members rotating in opposite directions. Other embodiments according to this publication employ the combination of a stationary cutting member operating in a direction opposite to the dragging direction and a rotary cutting member operating in the same direction as the dragging direction. With this known dragging type head, difficulties may arise when the cutting teeth hit stones or operate on a rocky soil.

The object of the invention is to provide a dragging type head in which these problems will not arise and which, moreover, is appropriate for operation in layers which are hard to be dredged, such as clay, without clogging of the cutting members.

In the first place, according to the invention, this is achieved in that only one cutting member is provided which is operative in a direction opposite to the dragging direction, the edges of the inlet opening extend to the outer circle of rotation of the teeth with the lower edge of said opening on the same level as the lower part of the cutting member, and the cutting teeth are pivotal around a horizontal axis and are maintained in the operating position by a spring, said spring exerting a force opposite to the forces acting upon the teeth. Due to the position of the inlet opening of the suction conduit, an intensive flow of water occurs in the space between the teeth, as a result of which the material loosened by the cutting teeth can be properly carried off into the suction conduit. Should the cutting teeth encounter an excessive resistance, e.g. in the form of a stone, which cannot be handled or broken by the cutting teeth, the teeth may deflect against the force of the spring so that the head may continue to operate. The spring may then be so arranged that, when a cutting tooth pivots against the force of the spring, the spring will effect complete resetting. Consequently, the teeth can exert a hitting action.

It is also be possible to arrange the spring so that it has the shape of a resilient body which is compressed when overloaded. Preferably, a body from foam plastic is then used, this being cheap and easy to replace.

It is observed here that, in my copending application Ser. No. 16,740, filed Mar. 2, 1979, it has been already proposed to apply only one cutting member operating in a direction opposite to the dragging direction and to allow the edges of the inlet opening to extend to the outer circle of rotation of the cutting member, with the lower edge of said opening on the same level as the lower part of the cutting member. However, this relates to a cylindrical cutting member with stationary cutting blades, the inner edge of which is situated at a distance from a cylinder jacket, through which a water flow to the inlet opening, both along the bottom- and topside can be induced, said flow stimulating the loosening of the shaved-off soil particles.

It is also observed that, from the Dutch Application No. 38.131, a bucket wheel for a dredger is known, in which the buckets are pivotably and resiliently suspended in such a manner that they deflect when encountering an excessive resistance.

Preferably, according to the invention, the dragging type head is provided, above the upper edge of the inlet opening, with scraper blades extending between the cutting teeth. In this manner it is achieved that soil particles remaining on the cutting teeth, such as clay, are removed.

To avoid that the cutting teeth between said scraper blades, respectively the cutting teeth with an enclosing cover plate produce a pumping effect directed away from the inlet opening of the suction conduit, it will be preferable, according to the invention, to provide the head with a water inlet opening above the upper edge of the inlet opening, as a result of which no water is withdrawn from the suction conduit and the output of the latter is not adversely affected. Moreover, the amount of water entering through said inlet opening will stimulate the cleaning of the cutting blades.

According to the invention, it is prefered that, when viewed in the direction of rotation of the cutting member, the front edge of the scraper blades is facing the water inlet opening. In this manner, a propelling or pumping effect in the direction toward the inlet mouthpiece is achieved. Due to a sufficiently high rotational speed, the cutting teeth will add a propelling effect to the flow at the location of the inlet opening. The teeth will propel the water in advance of them. At the location of the scraper blades, part of the propelled water cannot follow the cutting blades and can then escape only into the inlet opening. The cover may then be completely absent.

The invention will now be further illustrated while referring to the drawings.

Figure 1:
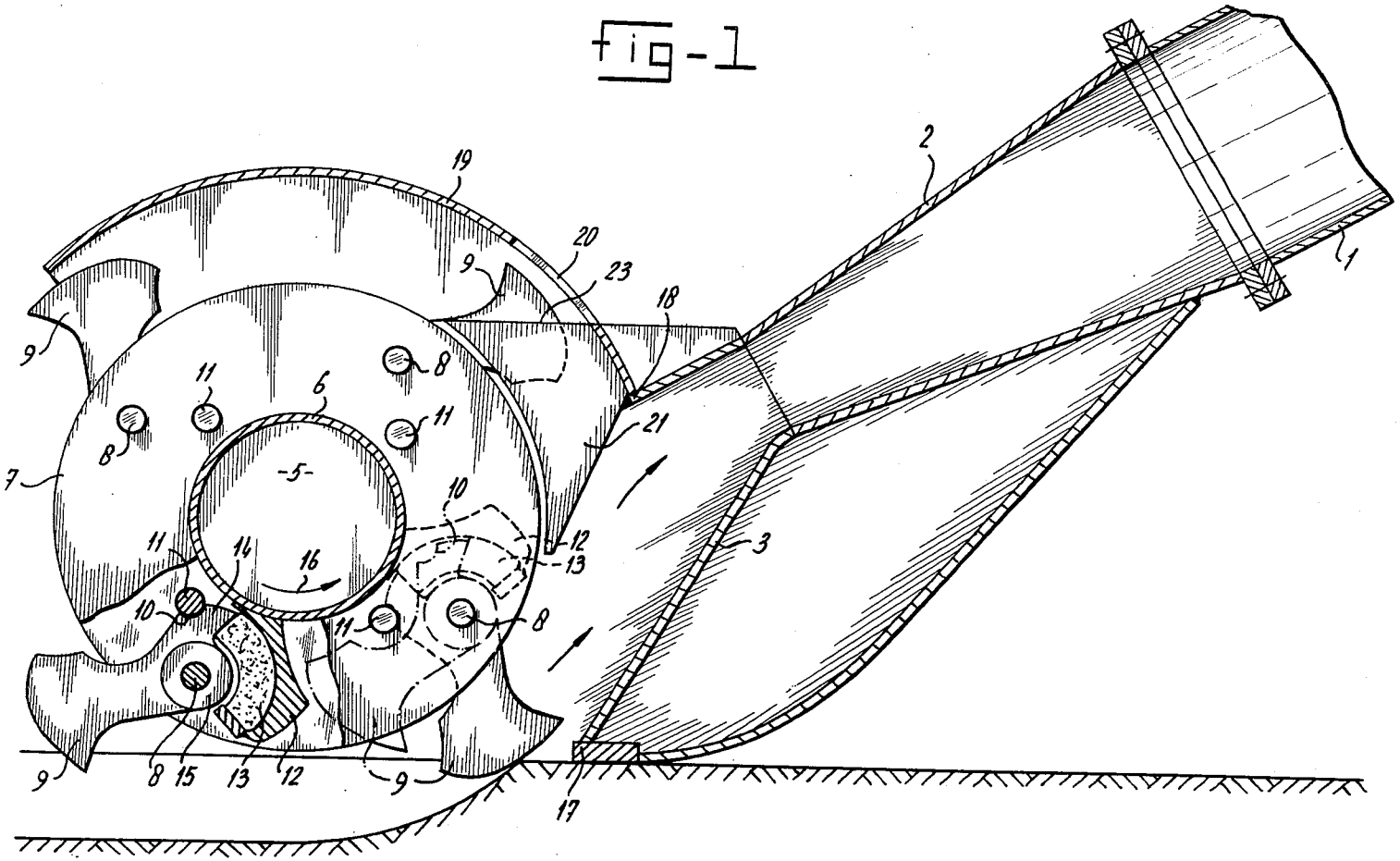
FIG. 1 shows the dragging type head according to the invention in section.

FIG. 1 shows a suction conduit 1 with a connecting piece 2 and an inlet mouth 3.

The driving members 5 of a rotatable body 6 are journalled in side-arms 4 of the head, said body 6 being provided with a plurality of discs 7 arranged in spaced apart relation. Through these discs, axes 8 extend on which cutting teeth 9 are pivotally journalled, which bear with a recess 10 against stopping pins 11.

On the cylinder 6, supports 12 are mounted, upon which blocks 13 of foam plastic acting as springs are placed, against which the cutting teeth 9 rest with an inwardly directed projection 14.

Instead of said blocks 13 of foam plastic, blocks of rubber may be used, or springs under tensile or compressive stress. Also, it will be possible to use torsional bar springs on the axes 8.

Figure 2:
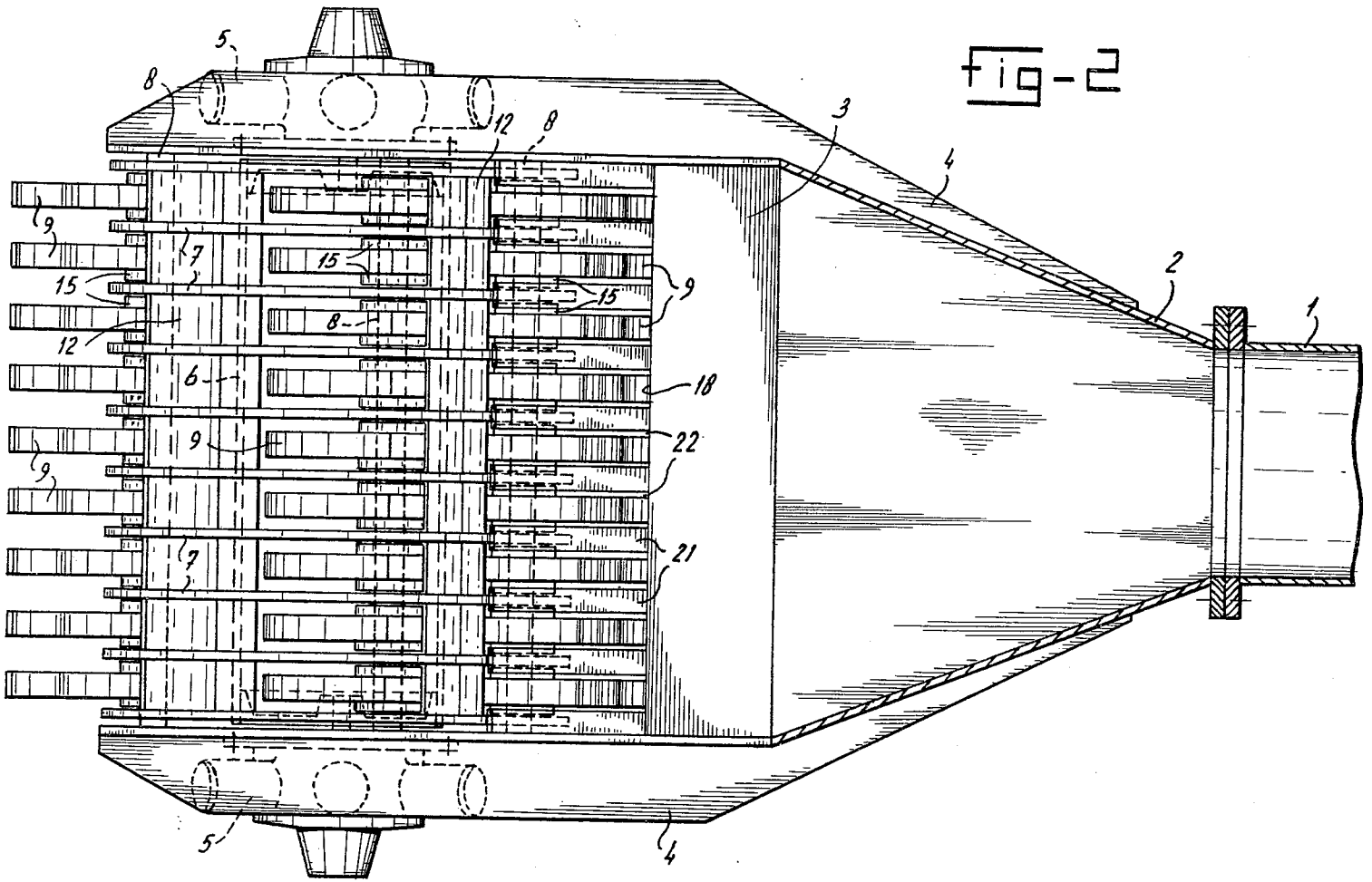
FIG. 2 shows a bottom view of the dragging type head of FIG. 1.

As will appear from FIG. 2, each cutting tooth 9 lies between the discs 7 with an enlarged part 15 and, therefore, sufficient space in transverse direction will be available for the mounting of resilient blocks or springs for each separate cutting blade.

The cutting member rotates in the direction of the arrow 16.

The inlet mouth is defined by the lower edge 17 and the upper edge 18.

Over the upper part of the cutting member a hood 19 extends, which is provided with a water inlet opening 20.

Closely adjacent the upper edge 18, plates 21 are mounted with a mutual interspace 22 of such width that the cutting teeth 9 are allowed to pass therethrough with a certain clearance. The plates 21 have an upper edge 23 which is situated under the inlet opening 20.

When in operation, the water drawn in through the suction conduit may flow between the cutting teeth so that the material loosened by the teeth is sucked off effectively. The plates 21 partly define the upper portion of the suction mouth and take care of removal of material sticking to the cutting teeth.

Should the cutting blades 9 encounter an additional resistance, they may swing backwards as shown by dashed lines at the lower right in FIG. 1.

By the invention a particularly simple and effective dragging type head is provided which can be used with practically all occurring types of soil. A covering leaf at the back will no longer be necessary.

With the dragging type head according to the invention, the loosened material is accelerated directly in the exact direction towards the inlet opening. Moreover, the material is flung off the cutting teeth by centrifugal force.

I claim:

1. In a dragging type cutter head for a suction dredger, comprising a suction conduit having an inlet having upper and lower edges and a substantially cylindrical cutting member comprising a cylindrical body rotatable about a horizontal axis, said body having at its periphery a series of cutting teeth disposed side-by-side in a direction parallel to the axis of the cutting member; the improvement in which only one cutting member is provided, said cutting member rotating in such a direction that the cutting teeth at the lowermost points in their rotation move in the dragging direction, the edges of the inlet opening extending to the outer circle of rotation of the teeth with the lower edge of said opening at the same level as the lower part of the cutting member, means mounting the cutting teeth for pivotal movement around horizontal axes parallel to but spaced from the axis of rotation of the cutting member, and spring means urging the teeth about their axes in the cutting direction.

2. A cutter head as claimed in claim 1, in which all the cutting teeth are resiliently spring urged independently from each other.

3. A cutter head as claimed in claim 1, in which said spring means comprise foam plastic blocks.

4. A cutter head as claimed in claim 3, and supports mounted on the cutting member that have concave surfaces confronting the axes of said cutting teeth, said foam plastic blocks being arcuate and nested in said concave surfaces.

5. A cutter head as claimed in claim 1, and scraper blades extending between the cutting teeth and disposed at the upper edge of the inlet opening.

6. A cutter head as claimed in claim 5, the scraper blades having leading edges which extend in a direction to divert material from between the cutting teeth into the inlet opening.

7. A cutter head as claimed in claim 1, and a water inlet opening above the upper edge of the first-mentioned inlet opening.

* * * * *